US005892170A

United States Patent [19]

Ichiki et al.

[11] Patent Number: 5,892,170

[45] Date of Patent: Apr. 6, 1999

[54] MUSICAL TONE GENERATION APPARATUS USING HIGH-SPEED BUS FOR DATA TRANSFER IN WAVEFORM MEMORY

[75] Inventors: Tetsuji Ichiki; Masahiro Shimizu, both of Hamamatsu, Japan

[73] Assignee: Yamaha Corporation, Hamamatsu, Japan

[21] Appl. No.: 882,123

[22] Filed: Jun. 25, 1997

[30] Foreign Application Priority Data

Jun. 28, 1996 [JP] Japan ..... 8-186892

[51] Int. Cl.[6] ..... G10H 7/04; G10H 7/12

[52] U.S. Cl. ..... 84/605; 84/607

[58] Field of Search ..... 84/603–607; 364/723, 364/724.1

[56] References Cited

U.S. PATENT DOCUMENTS

| | | | |
|---|---|---|---|
| 4,901,615 | 2/1990 | Matsushima et al. | 84/605 |
| 5,290,965 | 3/1994 | Yoshida et al. . | |
| 5,386,529 | 1/1995 | Kondo | 84/603 X |
| 5,525,748 | 6/1996 | Kuribayashi et al. | 84/604 X |
| 5,567,901 | 10/1996 | Gibson et al. | 84/603 |

*Primary Examiner*—Stanley J. Witkowski

*Attorney, Agent, or Firm*—Graham & James LLP

[57] ABSTRACT

A musical tone generation apparatus creates musical-tone-waveform samples based on waveform samples stored in a waveform memory by each sampling period. Herein, a high-speed bus such as a PCI bus is provided for data transfer with regard to the waveform memory. A waveform buffer is provided to temporarily and selectively store the waveform samples which are read from the waveform memory. A sound source operates in accordance with time-division-channel timings which are provided by dividing a sampling period by a number of channels. The sound source performs interpolation calculations on the waveform samples of the waveform buffer to create a musical-tone-waveform sample in accordance with each time-division-channel timing with respect to each channel. The apparatus generates a read address whose value is changed in response to a pitch of a musical tone. When the waveform buffer does not store the waveform samples which are necessary to create the musical-tone-waveform sample, the apparatus accesses the waveform memory in accordance with the read address to read out the waveform samples, which are then transferred to the waveform buffer via the high-speed bus. Herein, burst reading operations are performed on the waveform memory, regardless of the time-division-channel timing. Thus, it is possible to reduce an occupancy time of the high-speed bus by the sound source as well as a number of times to access the waveform memory.

16 Claims, 8 Drawing Sheets

TIME
1 SAMPLING PERIOD
(PROCESS A)
1ST HALF (0ch-31ch)
2ND HALF (32ch-63ch)
701
705

(PROCESS B)
1ST HALF (0ch-31ch)
2ND HALF (32ch-63ch)
702
706

(LOAD PROCESS)
1ST HALF (0ch-31ch)
2ND HALF (32ch-63ch)
703
707

(INTERPOLATION PROCESS)
1ST HALF (0ch-31ch)
2ND HALF (32ch-63ch)
704
708

MUSICAL TONE GENERATION APPARATUS USING HIGH-SPEED BUS FOR DATA TRANSFER IN WAVEFORM MEMORY

BACKGROUND OF THE INVENTION

This invention relates to musical tone generation apparatuses which generate musical tones using waveform memories. Particularly, this invention uses the high-speed bus such as the PCI bus to perform reading and writing operations on the waveform memory.

The PCI bus (or PCI local bus, where 'PCI' is an abbreviation for 'Peripheral Component Interconnect') is a local bus architecture designed to put peripheral on an electrical pathway closer to the central processing unit in order to improve the performance of the computer system.

The sound source device of the waveform memory type is developed to enable the simultaneous generation of multiple musical tones corresponding to multiple channels in a time division system. Herein, 1 sampling period is divided into multiple time slots, each having a same time length, which correspond to channels respectively. Each time slot is used to perform a musical tone generating operation with respect to each channel. The waveform memory stores waveform samples (or sampled waveforms) with respect to the time slots respectively. So, the device accesses the waveform memory a certain number of times. Interpolation calculations are performed on a number of waveform samples which are read from the waveform memory with respect to a number of consecutive points of the sampling. Thus, the device generates musical tone waveform data with respect to 1 sampling point.

Meanwhile, the electronic musical instrument of the waveform memory type uses the central processing unit (i.e., CPU) to control overall operations thereof. Herein, the memory stores control programs as well as waveform samples. So, the memory is shared by the CPU and sound source section.

In the sound source systems of the electronic musical instruments, the access of the memory is the bottleneck element. In the general, many of the systems are designed such that the bus coupled to the waveform memory is connected to the sound source section only. In order to change the stored contents of the waveform memory, some of the systems are designed to enable the time-division usage of the bus between the CPU and sound source section. So, the CPU and sound source section alternatively access the waveform memory in accordance with clock pulses of the time division system. Herein, a certain number of access slots (i.e., time slots for the access) are exclusively used for the CPU. In other words, the access slots for the CPU are continuously secured even if the CPU does not access the waveform memory to perform reading and/or writing operations. Thus, the access is performed on the waveform memory with a low efficiency. In some cases, the sound source section requires a large number of times to access the waveform memory to perform the generation of musical tones, wherein 'a number of times to access' will be referred to as 'access times'. However, due to the reason described above, the access times should be limited. This may cause a limitation in generation of musical tones. That is, the system may suffer from a demand that a number of musical tones should be limited due to the limited access times. Further, in the duration that the sound source section accesses the waveform memory, the other circuits such as the CPU and SCSI interface (where 'SCSI' is an interface standard for small computer system interface) cannot use the bus. Those are disadvantages and problems which this invention should solve.

Moreover, to perform the interpolation calculations with respect to each channel, the system should perform the memory access 2 times in each sampling period. By the way, the common bus such as the PCI bus has the so-called "bus arbiter" (or "bus arbitration" which represents a procedure that resolves priorities among units contending for control of the common bus and that passes control to the selected unit). That is, the above common bus responds to priorities to perform assignment of the bus, so the usage right of the bus is assigned to the selected unit. In the case of the common bus having the bus arbiter, however, if the system changes over the usage rights of the bus many times, the usage efficiency of the bus as a whole should be lowered. This is another problem which this invention should solve.

SUMMARY OF THE INVENTION

It is an object of the invention to provide a musical tone generation apparatus which is capable of reducing an occupancy time to occupy a bus by a sound source as well as reducing a frequency to access a bus.

A musical tone generation apparatus of this invention is characterized by using a high-speed bus such as a PCI bus for data transfer with regard to a waveform memory. A waveform buffer is provided to temporarily and selectively store waveform samples which are read from the waveform memory. A sound source operates in accordance with time-division-channel timings which are provided by dividing a sampling period by a number of channels. The sound source performs interpolation calculations on the waveform samples of the waveform buffer to create a musical-tone-waveform sample in accordance with each time-division-channel timing with respect to each channel. The apparatus generates a read address whose value is changed in response to a pitch of a musical tone. When the waveform buffer does not store the waveform samples which are necessary to create the musical-tone-waveform sample, the apparatus accesses the waveform memory in accordance with the read address to read out the waveform samples, which are then transferred to the waveform buffer via the high-speed bus. Herein, burst reading operations are performed on the waveform memory, regardless of the time-division-channel timing. Thus, it is possible to reduce an occupancy time of the high-speed bus by the sound source as well as a number of times to access the waveform memory.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Now, a description will be given with respect to a musical tone generation apparatus which is designed in accordance with an embodiment of the invention.

Figure 1:
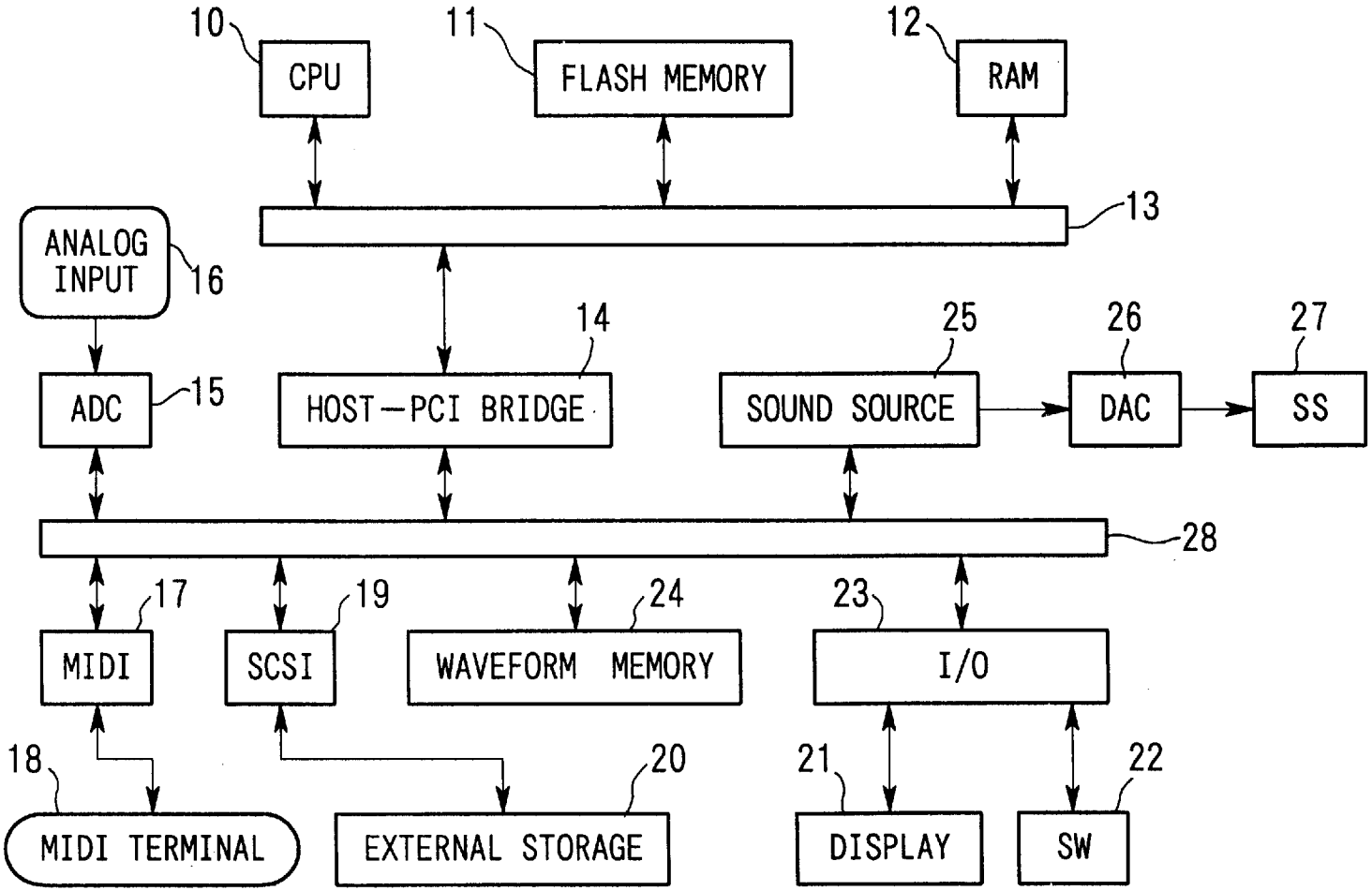
FIG. 1 is a block diagram showing an overall configuration of a musical tone generation apparatus which is designed in accordance with an embodiment of the invention.

FIG. 1 is a block diagram showing an overall configuration of the musical tone generation apparatus of the present embodiment.

A CPU 10 performs an overall control on the musical tone generation apparatus as a whole. A flash memory 11 stores an operating system (OS) based on which the musical tone generation apparatus operates. In addition, the flash memory 11 stores basic operation programs for the musical tone generation apparatus as well as constant data representing constants. A random-access memory (RAM) 12 has storage areas which are used as work registers and the like. All of the CPU 10, flash memory 11 and RAM 12 are connected to a CPU local bus 13.

As the operating system stored in the flash memory 11, it is preferable to use the pre-emptive multitasking operating system.

Analog signals such as musical tone signals and voice signals are input to an analog input terminal 16. An analog-to-digital converter (abbreviated by 'ADC' or 'A/D converter') 15 is provided to enter the analog signals into the musical tone generation apparatus. On the other hand, MIDI signals (where 'MIDI' is a standard for 'Musical Instrument Digital Interface') are input to a MIDI terminal 18. A MIDI interface 17 is provided to perform transmission of the MIDI signals. An external storage device 20 is configured by a hard-disk unit or a CD-ROM drive. A SCSI interface 19 is provided as the interface with respect to the external storage device 20. A display unit 21 visually displays a variety of information and data on a screen thereof. A switch unit 22 contains switches to input instructions and commands given by the user. An input/output control circuit 23 is provided as the interface with respect to the display unit 21 and switch unit 22.

A waveform memory 24 stores waveform sample data which are produced by performing sampling at a predetermined rate (e.g., 50 kHz). In addition, the waveform memory 24 is used as the storage to load waveform data stored in the external storage unit 20 and flash memory 11 and other waveform data which are created by calculations performed by the CPU 10, as well as waveform sample data corresponding to digital signals which the A/D converter 15 produces by performing analog-to-digital conversion on the analog signals input to the analog input terminal 16. The waveform memory 24 is configured by a dynamic random-access memory (i.e., DRAM), for example. In the present embodiment, 1 waveform sample corresponds to 16-bit data of the non-compression form.

The musical tone generation apparatus of the present embodiment uses a sound source section 25 for the creation of musical tones. The specifics of the sound source section 25 will be described later; however, an overall operation of the sound source section 25 can be simply described as follows:

Responding to instructions of the CPU 10, waveform samples are read from the waveform memory 24. The read waveform samples are subjected to a variety of processes such as interpolation calculations, envelop imparting operations, channel accumulation operations and effect imparting operations. Thus, musical tone waveform sample data are created and are outputted by each sampling period. In the present embodiment, the sound source section 25 has a capability to generate musical tones of 64 tone-generation channels.

The musical tone waveform sample data, which are outputted from the sound source section 25 by each sampling period, are forwarded to a digital-to-analog converter (abbreviated by 'DAC' or 'D/A converter') 26 wherein they are converted to analog musical tone signals. A sound system (represented by 'SS') amplifies the musical tone signals to produce the corresponding musical tones.

All of the AID converter 15, MIDI interface 17, SCSI interface 19, I/O control circuit 23, waveform memory 24 and sound source section 25 are connected to a POT bus 28. The PCI bus 28 enables high-speed data transfer among them mutually. Incidentally, the PCI bus 28 has a capability to transfer data of 32 bits. In the present embodiment, a bus clock frequency of the PCI bus 28 is set at 32 kHz. Further, by employing a burst transfer mode, it is possible to perform a data transfer with a higher speed.

A HOST-PCI bridge circuit 14 is connected between the CPU local bus 13 and the PCI bus 28. So, the CPU 10 is capable of accessing the circuits elements such as the waveform memory 24, which are connected to the PCI bus 28, by means of the HOST-PCI bridge circuit 14. Incidentally, the bus arbiter of the PCI bus 28 is provided inside of the HOST-PCI bridge circuit 14, for example.

Some PCI-bus-related circuits such as the HOST-PCI bridge circuit 14, MIDI interface 17, SCSI interface 19, I/0 control circuit 23 and sound source section 25 are capable of acting as the "bus master" which has a right to use the PCI bus 28 in accordance with the procedures as follows:

To use the PCI bus 28, the circuit sends a bus usage request to the bus arbiter. After the circuit receives a bus usage permission, it performs a data transfer.

For example, the SCSI interface 19 performs a data transfer with respect to a certain device such as a hard-disk unit (not shown) which is connected thereto upon an instruction given from the CPU 10. In addition, the SISI interface 19 acts as the bus master. That is, the SCSI interface 19 operates such that waveform sample data are transferred from the hard-disk unit to the waveform memory 24; or the waveform sample data from the waveform memory 24 are saved on the hard-disk unit.

The sound source section 25 divides 1 DAC cycle into 2 sections. With respect to each section of the DAC cycle, in other words, with respect to a half period of the 1 DAC cycle, the sound source section 25 makes a decision as to whether or not the reading of the waveform memory 24 is necessary. In the present embodiment, a half period of the 1 DAC cycle corresponds to 100 kHz. If it is necessary to read a waveform sample from the waveform memory 24, a bus usage request of the PCI bus 28 is sent to the bus arbiter. So, after receiving a bus usage right (or bus usage permission), the sound source section 25 accesses the waveform memory 24.

All the aforementioned circuits elements, except the sound source section 25, may be similar to the circuits elements which construct the general-use personal computer system. So, this invention can be easily realized on the personal computers equipped with the waveform memory and sound source connected to the PCI bus. If the present embodiment is actually realized by the personal computer, some minor modifications should be made as follows:

The flash memory 11 is replaced by a RAM which acts as a main memory. In addition, the aforementioned operating system is replaced by a certain operating system suited to the personal computer.

However, to shorten the latency or to improve the real-time performance by using the high-speed performance of the PCI bus, it is preferable to use the pre-emptive multi-tasking operating system which is capable of executing multiple input/output processes in parallel.

Figure 2:
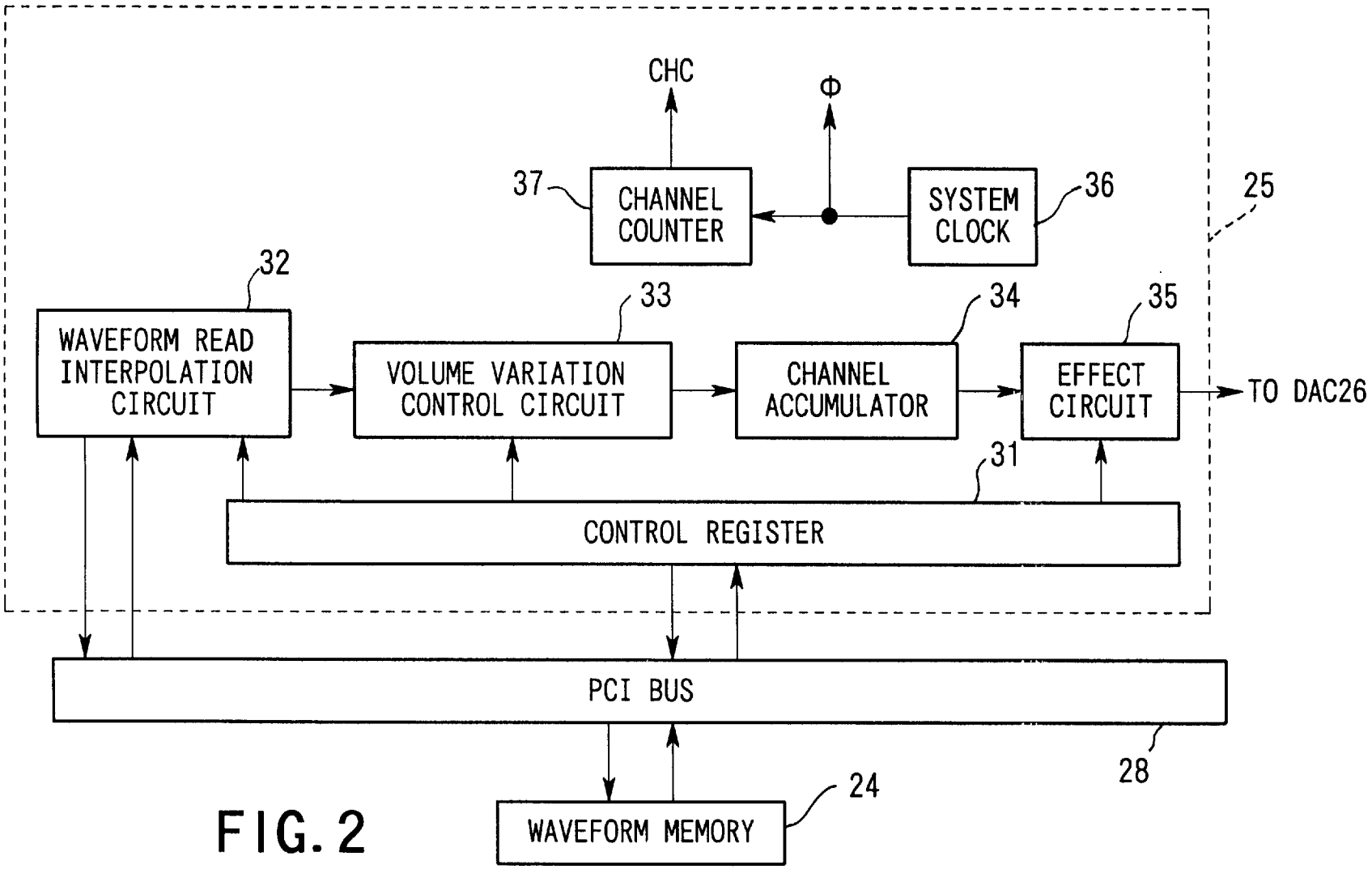
FIG. 2 is a block diagram showing an internal configuration of a sound source section shown in FIG. 1.

FIG. 2 shows an internal configuration of the sound source section 25. In FIG. 2, a control register 31 stores designation information sent from the CPU 10. For example, the designation information represents assigning channels, pitches (or F-numbers) for the reading of the waveform memory, reading ranges of the waveform memory, and coefficients for imparting the envelope(s) and effect(s). A waveform read interpolation circuit 32 is provided to perform complicated works, the details of which will be described later. Simply speaking, the waveform read interpolation circuit 32 performs a series of operations as follows:

Waveform samples are read from the waveform memory 24. Certain interpolation calculations are performed on the waveform samples to produce interpolated musical tone waveform samples.

A volume variation control circuit 33 operates based on parameters given from the control register 31 so as to impart an envelope to the musical tone waveform samples which are outputted from the waveform read interpolation circuit 32 with respect to each tone-generation channel. A channel accumulator 34 receives envelope-imparted musical tone waveform samples from the volume variation control circuit 33 to accumulate them with respect to each tone-generation channel. An effect circuit 35 performs a predetermined effect process, using effect coefficients given from the control register 31, on an output of the channel accumulator 34. Thus, the effect circuit 35 produces effect-imparted musical tone waveform samples, which are then forwarded to the aforementioned D/A converter 26 with respect to 1 sampling period. They are converted to analog signals. So, the sound system 27 generates musical tones based on the analog signals.

A system clock generation circuit 36 generates a system clock signal $\phi$ consisting of clock pulses which are used as the reference for the operation of the sound source section 25. The system clock signal is delivered to some circuits, units and sections of the musical tone generation apparatus of the present embodiment. A channel counter 37 receives the system clock signal $\phi$ from the system clock generation circuit 36 to produce a channel count value CHC. Based on the system clock signal $\phi$ and the chanel count value CHC, the sound source section 25 divides 1 sampling period (i.e., 1 DAC cycle) into a number of time slots corresponding to 64 tone-generation channels. So, a specific process is performed on each tone-generation channel at each time-division-channel timing (or time-division-channel time unit).

The processing of the waveform read interpolation circuit 32 is mainly divided into 4 processes, i.e., process A, process B, load process and interpolation process, operations of which will be simply described below.

(1) Process A

The circuit produces a read address of the waveform memory with respect to a certain channel in accordance with the time-division-channel timing. Based on a result of this operation, a decision is made as to whether or not the reading of waveform samples from the waveform memory is required for the channel.

(2) Process B

When it is necessary to read waveform samples, the circuit is activated to perform the process B. That is, the circuit obtains a usage right of the PCI bus 28; then, the circuit sends a read address 'WMA' to the waveform memory 24 at a timing which is different from the time-division channel timing.

(3) Load Process

The load process follows the process B in which the waveform sample is read out in accordance with the read address. So, the circuit performs the load process to load the waveform sample into a waveform buffer which will be described later.

(4) Interpolation Process

The circuit performs 4-point interpolation calculations on waveform samples, stored in the waveform buffer, in accordance with time-division channel timings. So, the circuit produces interpolated musical tone waveform samples.

Figure 3:
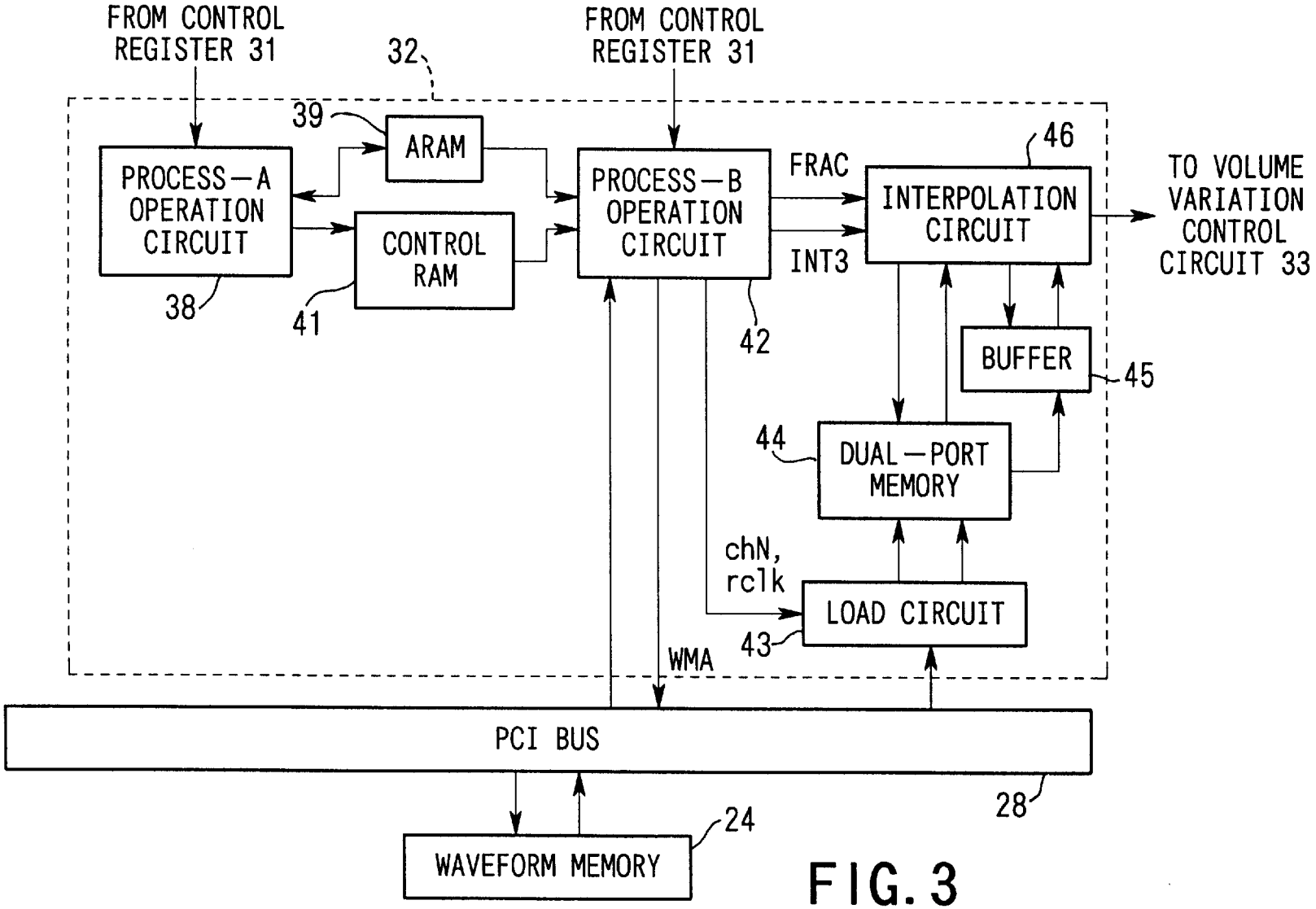
FIG. 3 is a block diagram showing an internal configuration of a waveform read interpolation circuit shown in FIG. 2.

FIG. 3 shows an internal configuration of the waveform read interpolation circuit 32. Herein, a process-A operation circuit 38 executes the aforementioned process A in which read addresses are produced with respect to channels respectively. The read addresses are retained in an address RAM (abbreviated by 'ARAM') 39. On the other hand, the process A determines a channel from which a waveform sample should be read out. So, a channel number assigned to the above channel is stored in a control RAM 41. Next, a process-B operation circuit 42 executes the aforementioned process B based on the channel number stored in the control RAM 41 as well as the read address stored in the address RAM 39. A load process circuit 43 executes the load process. A dual-port memory 44 has a capability of storing 8 waveform samples per each channel. A buffer 45 has a capability of storing 4 waveform samples per each channel. A waveform buffer is configured by the dual-port memory 44 and the buffer 45. So, the waveform buffer has a capability of storing total 12 waveform samples per each channel. An interpolation circuit 47 performs interpolation calculations on the waveform samples stored in the dual-port memory 44 and the buffer 45. Herein, the interpolation calculations are performed based on parts of read addresses which are supplied thereto from the process-B operation circuit 42. Specifically, the interpolation calculations are performed based on a decimal (fraction) part FRAC of the read address as well as a low-order-3-bits value INT3 within an integer part of the read address. Incidentally, the decimal part of the read address will be referred to as an address decimal part, whilst the integer part of the read address will be referred to as an address integer part.

Figure 4:
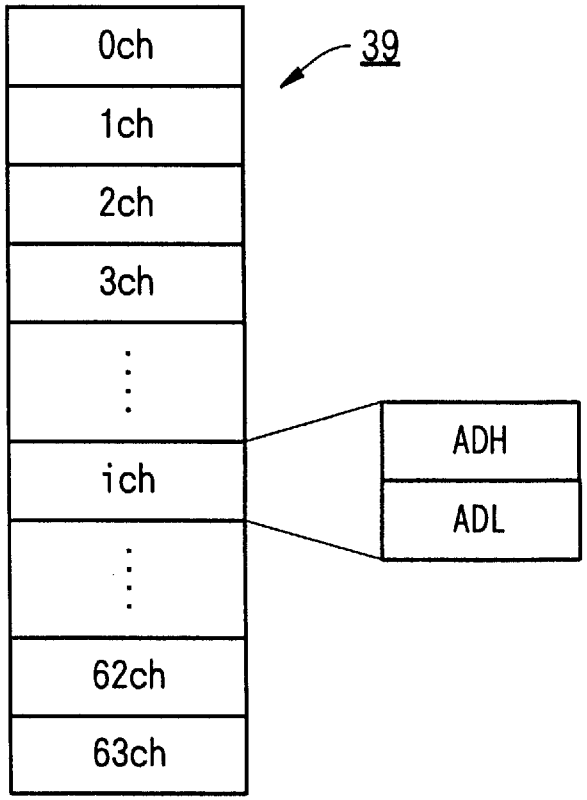
FIG. 4 shows an example of a memory map of an address RAM shown in FIG. 3.

FIG. 4 shows an example of a memory map of the address RAM 39. As shown in FIG. 4, there are provided 64 storage areas which respectively correspond to 64 channels numbered from channel 0 to channel 63. Each storage area consists of a high-order-address storage portion ADH and a low-order-address storage portion ADL. Herein, the high-order-address storage portion ADH stores high-order 18 bits of the address integer part, whilst the low-order-address storage portion ADL stores low-order 9 bits of the address integer part as well as the address decimal part which consists of 9 bits. The address integer part consists of total 27 bits. In addition, the address integer part corresponds to a unit of the address of the waveform memory 24. Further, one waveform sample exists on the waveform memory 24 in response to a value representing the address integer part. The address decimal part of 9 bits indicates a smaller value which is less than the unit of the address. The present embodiment uses 4 waveform samples in the interpolation process, wherein the interpolated waveform sample is calculated with respect to the address which incorporates the address decimal part.

Figure 5:
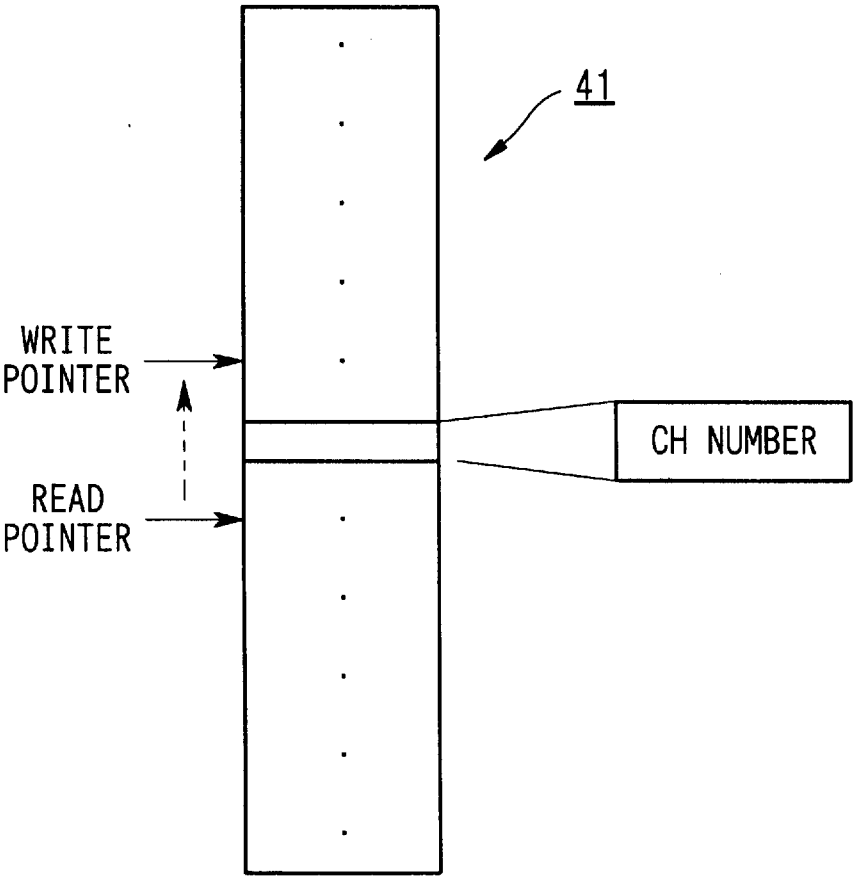
FIG. 5 shows an example of a memory map of a control RAM shown in FIG. 3.

FIG. 5 simply shows a memory map of the control RAM 41. As described before, the waveform buffer (i.e., dual-port memory 44 plus buffer 45) is provided inside of the waveform read interpolation circuit 32 to store 12 waveform samples per each channel. Thanks to the above configuration, it is not necessary to read the waveform samples of the waveform buffer again from the waveform memory 24. In some case, however, the waveform buffer does not store waveform samples, used for the interpolation calculations, which respond to the read address produced by the process A. So, only in such a case (in other words, in a read request mode), the waveform read interpolation circuit 32 is requested to read the waveform samples from the waveform memory 24 at the time-division channel timing. A certain tone-generation channel requires such reading of the waveform samples, wherein a channel number thereof is detected by the process-A operation circuit 38 and is written into the control RAM 41.

The waveform read interpolation circuit 32 is equipped with a write pointer and a read pointer. At the aforementioned read request mode of the process A, a channel number of a tone-generation channel for which waveform samples should samples should be read out is written into the control RAM 41. At this time, the write pointer advances. On the other hand, when the channel number is read from the control RAM 41 in the aforementioned process B, the read pointer advances. Storage areas of the control RAM 41 are used in a ring-like manner. So, when either the write pointer or read pointer reaches one end of the control RAM 41, it nextly moves to another end of the control RAM 41. In the control RAM 41, read and write operations are performed in such a way that a location designated by the write pointer is followed by a location designated by the read pointer. Herein, there is provided a certain size of storage area between the locations of the read and write pointers. The above size of storage area is determined such that the read pointer does not pass the write pointer. In the present embodiment, there are provided 2 independent pointers as the write pointer as well as 2 independent pointers as the read pointer. Herein, one of them is provided for a first-half process, whilst another one is provided for a second-half process. For convenience' sake, however, the term "write pointer" is consistently used, regardless of the first-half and second-half processes. Similarly, the term "read pointer" is consistently used, regardless of the first-half and second-half processes.

Figure 6:
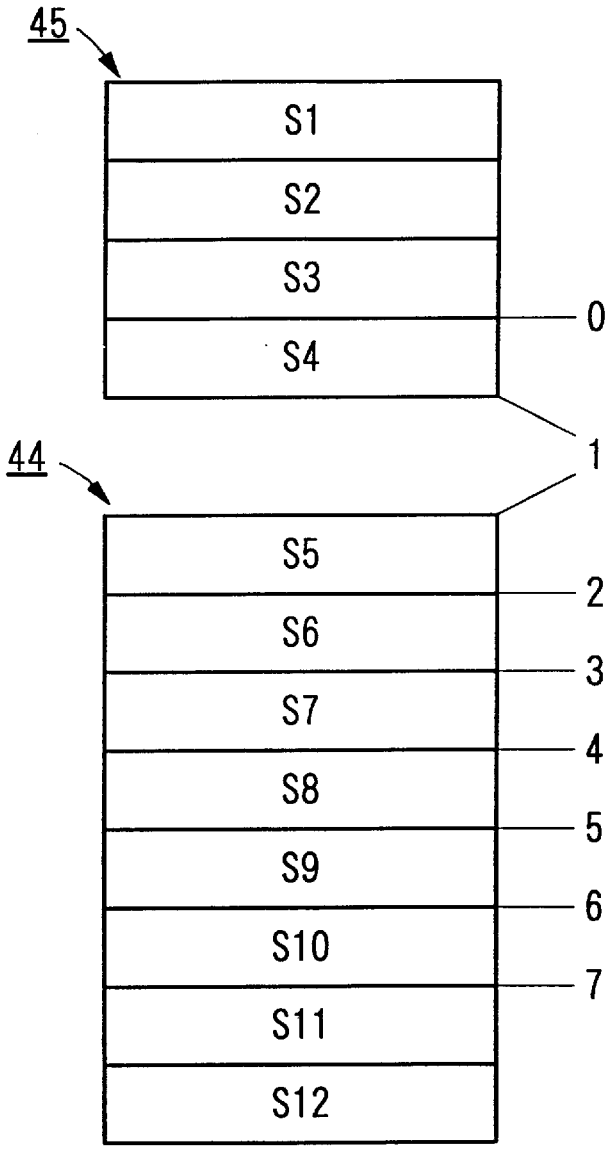
FIG. 6 shows an example of a memory map of a waveform buffer.

FIG. 6 shows an example of a memory map of the waveform buffer which corresponds to a combination of the dual-port memory 44 and the buffer 45. Herein, the buffer 45 has 4 sample storage areas S1 to S4, whilst the dual-port memory 44 has 8 sample storage areas S5 to S12 per each channel. So, the waveform memory of FIG. 6 has total 12 storage areas S1 to S12 for storing waveform samples per each channel.

Figures 7A, 7B, 7C, 7D:
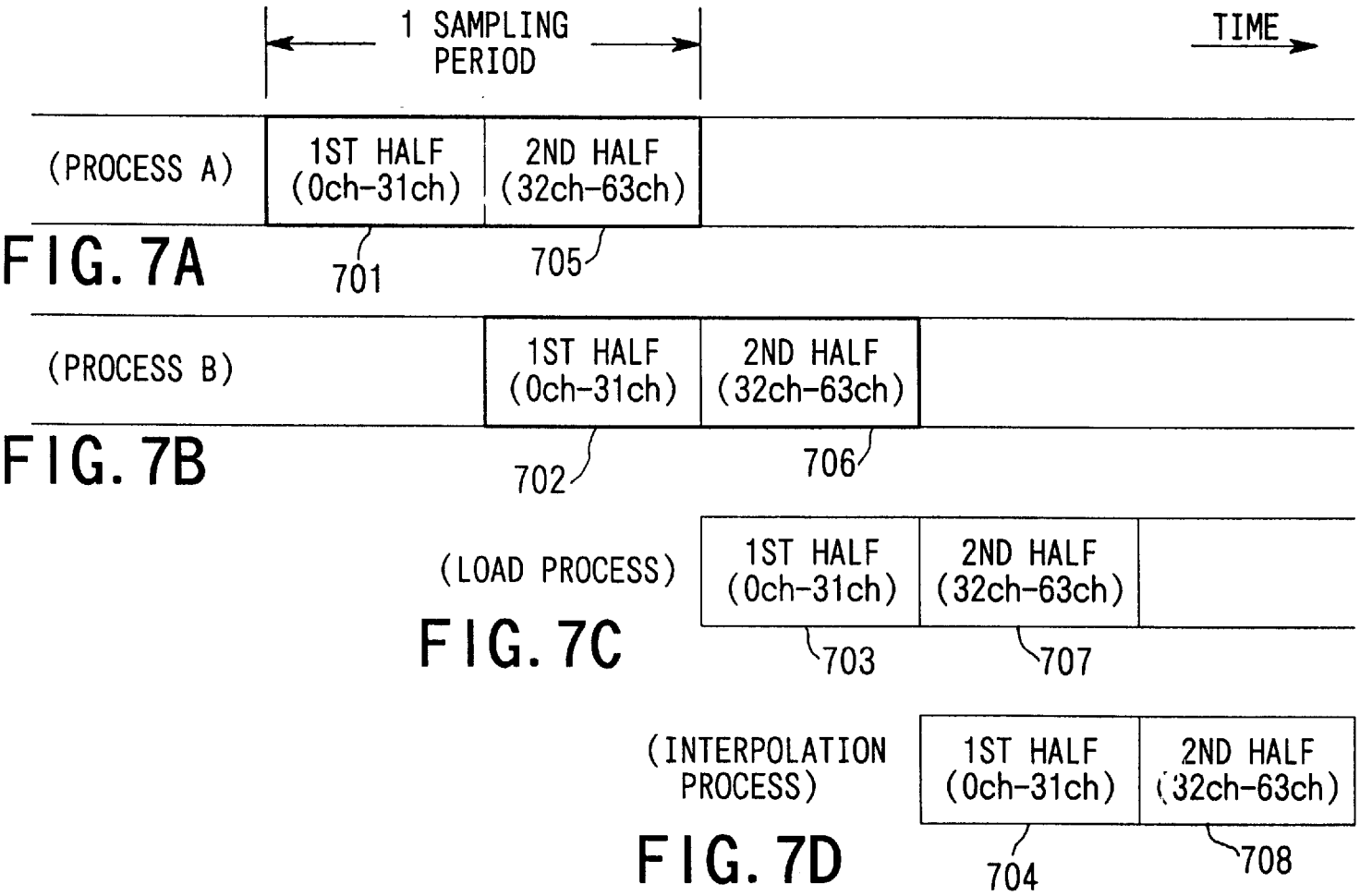
FIGS. 7A, 7B, 7C and 7D are time charts showing relationships between processes and channels.

Next, a description will be given with respect to the specifics of the aforementioned processes executed by the waveform read interpolation circuit 32. FIG. 7A is a time chart for the process A; FIG. 7B is a time chart for the process B; FIG. 7C is a time chart for the load process ; and FIG. 7D is a time chart for the interpolation process. In the sound source section 25, an interval of time for executing each process (i.e., process time) is divided into 2 durations, i.e., a first-half duration and a second-half duration. Herein, a first-half group of channels, ranging from channel 0 to channel 31 (represented by numerals '0ch' to '31ch'), are processed in the first-half duration, whilst a second-half group of channels, ranging from channel 32 to channel 63 (represented by numerals '32ch' to '63ch'), are processed in the second-half duration.

As described above, 1 sampling period is divided into the first-half and second-half durations. As for the process A shown in FIG. 7A, a first-half process is executed in a first-half duration 701; then, a second-half process is executed in a second-half duration 705. So, the first-half group of channels (i.e., channel 0 to channel 31) are subjected to the first-half process 701; then, the second-half group of channels (i.e., channel 32 to channel 63) are subjected to the second-half process 705. As for the process B shown in FIG. 7B, a first-half process is executed in a first-half duration 702; then, a second-half process is executed in a second-half duration 706. So, the first-half group of channels are subjected to the first-half process 702; then, the second-half group of channels are subjected to the second-half process 706. The first-half process 702 of the process B is started just after the first-half process 701 of the process A is ended. In addition, the second-half process 706 of the process B is started just after the second-half process of the process A is ended.

The load process relates to the timing to send the address in the process B. So, the load process is executed at the same timing of the process B. That is, a first-half process 703 of the load process is executed at the same timing of the first-half process 702 of the process B; then, a second-half process 707 of the load process is executed at the same timing of the second-half process 706 of the process B.

As for the interpolation process, a first-half process is executed in a first-half duration 704; then, a second-half process is executed in a second-half duration 708. So, the first-half group of channels are subjected to the first-half process 704; then, the second-half group of channels are subjected to the second-half process 708.

Figures 8A, 8B, 8C, 8D:
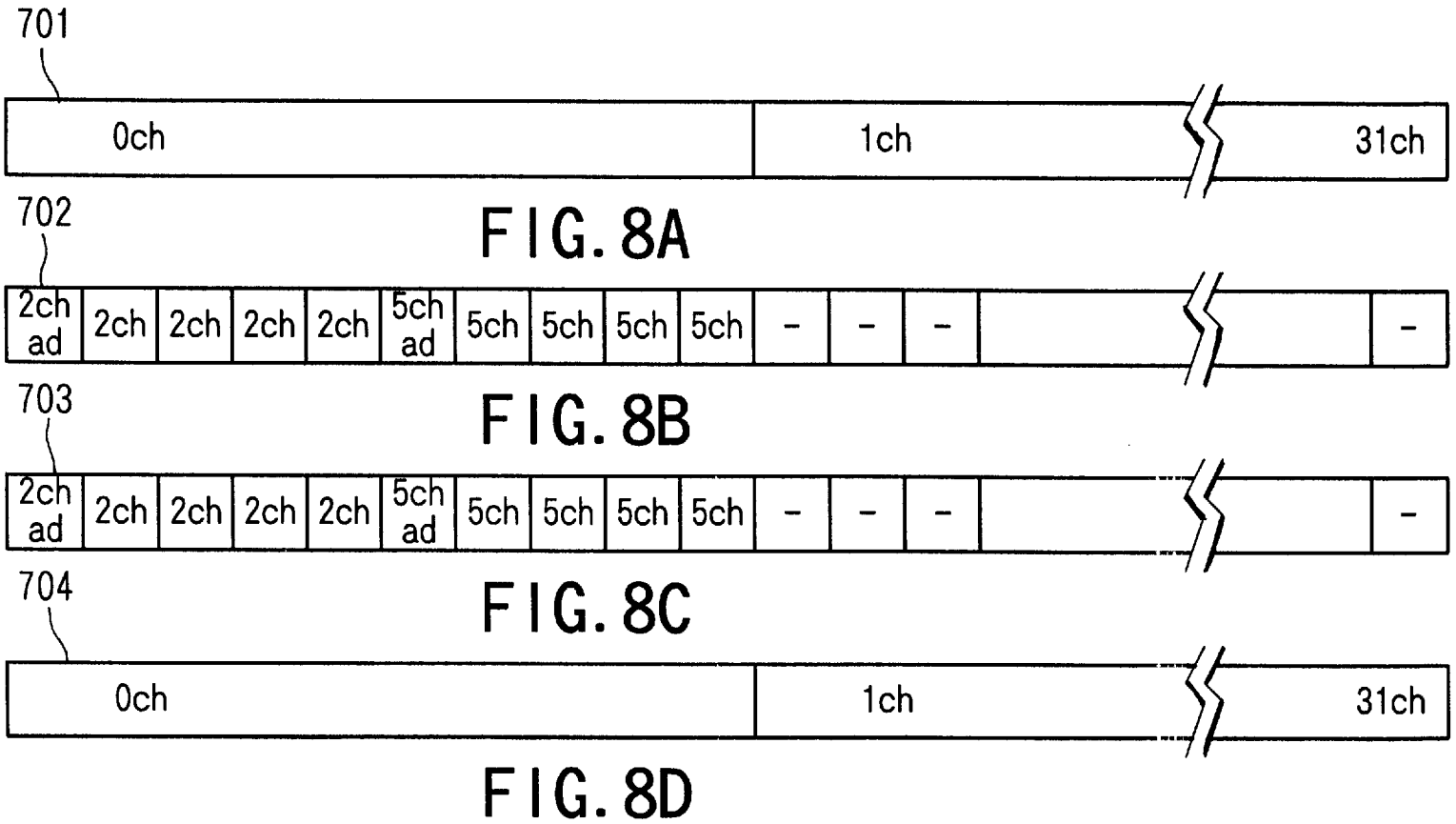
FIGS. 8A, 8B, 8C and 8D are time charts showing arrangements of channels to execute processes.

FIGS. 8A to 8D show arrangements of channels which are subjected to the aforementioned processes with respect to their first-half processes. Specifically, FIG. 8A shows an arrangement of the channels which are sequentially subjected to the first-half process 701 of the process A; FIG. 8B shows an arrangement of the channels which are sequentially subjected to the first-half process 702 of the process B; FIG. 8C shows an arrangement of the channels which are sequentially subjected to the first-half process 703 of the load process; and FIG. 8D shows an arrangement of the channels which are sequentially subjected to the first-half process 704 of the interpolation process. For convenience' sake, FIGS. 8A to 8D are drawn in such a way that the first-half processes 701 to 704 are disposed uniformly in a vertical direction. However, as shown in FIGS. 7A to 7D, certain time-related relationships are maintained between the processes 701 to 704.

In the present embodiment, 1 sampling period is divided into 64 segments each having an equal interval of time. Herein, each of the 64 segments corresponds to a time-division channel timing. As shown in FIGS. 7A and 8A, segment processes of the process A are sequentially executed with respect to the channels in accordance with the time-division-channel timings. Similarly, segment processes of the interpolation process (see FIGS. 7D and 8D) are sequentially executed with respect to the channels in accordance with the time-division-channel timings. Different from the aforementioned process A and interpolation process, the process B and load process are executed in accordance with fine timings which are provided independently of the time-division-channel timings. As described before, certain specifications are set to the present embodiment such that 1 sampling period is set at 50 kHz and a bus clock frequency of the PCI bus 28 is set at 32 MHz. So, the present embodiment is capable of executing a number of fine segment processes corresponding to 10 bus clock pulses within a duration to execute a single segment process of a single channel. As for the process B and load process (see FIGS. 7B, 7C and FIGS. 8B, 8C), the fine segment processes are consecutively executed with respect to the channels to which access is required. Herein, the fine segment processes are executed in a front-loading manner in accordance with the fine timings which are provided independently of the time-division-channel timings.

In the first-half duration 701 to execute the first-half process of the process A, the process-A operation circuit 38 sequentially produces addresses with respect to the first-half group of channels (i.e., channel 0 to channel 31) in accordance with the time-division-channel timings. So, at an end of the first-half duration 701, the address RAM 39 stores all of read addresses regarding the first-half group of channels.

In the first-half duration 702 to execute the first-half process of the process B, the process-B operation circuit 42 outputs addresses regarding the channel 2 and channel 5 (shown by '2ch' and '5ch') at the fine segment timings which are different from the time-division-channel timings. FIGS. 8B and 8C show an example that reading of waveform samples from the waveform memory 24 is required with respect to the channel 2 and channel 5 only. In this example, other channels are non-tone-generation channels, or they are channels that can perform interpolation calculations using the waveform samples which have been already read from the waveform memory 24 and stored in the dual-port memory 44 or buffer 45. Incidentally, the non-tone-generation channels are channels whose tone volumes are lowered in levels. The non-tone-generation channels are controlled not to use access timings (i.e., fine segment timings) of the process B to access the waveform memory 24.

In the first-half duration 702 of the process B shown in FIG. 8B, a read address of the channel 2 (shown by '2ch' and 'ad') is outputted at a timing of a first clock pulse. Then, burst reading operations are performed at timings of 4 clock pulses following the first clock pulse. That is, 32-bit data are consecutively read out, using the above read address as a location to start reading, at timings of second to fifth clock pulses. Next, a read address of the channel 5 is outputted at a timing of a sixth clock pulse. Then, 32-bit data are consecutively read out, using the above read address as a location to start reading, at timings of seventh to tenth clock pulses following the sixth clock pulse. So, the load circuit 43 operates in the first-half duration 703 of the load process to sequentially load 8 waveform samples (i.e., 4 words) regarding the channel 2 as well as 8 waveform samples regarding the channel 5. As described above, those waveform samples are read from the waveform memory 24 by the burst reading operations. The waveform samples are stored in storage areas of the dual-port memory 44 with respect to the channels respectively.

In the first-half duration 704 of the interpolation process, the interpolation circuit 46 performs interpolation calculations, using waveform samples stored in the dual-port memory 44 and the buffer 45, with respect to the first-half group of channels (i.e., channel 0 to channel 31) respectively. The interpolation calculations are performed in accordance with the time-division-channel timings. The present embodiment is designed in such a way that at a timing to perform interpolation calculations with respect to a certain channel, its corresponding waveform samples are prepared by the dual-port memory 44 or the buffer 45 in advance.

As described heretofore, musical-tone-waveform data are produced with respect to the first-half group of channels (i.e., channel 0 to channel 31) respectively. Similarly, the second-half durations 705 to 708 of the aforementioned processes are used to produce musical-tone-waveform data with respect to the second-half group of channels (i.e., channel 32 to channel 63) respectively.

As described before, the process B and load process are respectively executed by the aforementioned fine segment timings which are different from the time-division-channel timings. Due to such a nature of the present embodiment, there is a possibility that vacant time slots may emerge. Blocks (i.e., fine segment time units) accompanied with bars (-) in the durations 702 and 703 shown in FIGS. 8B and 8C designate vacant time slots which do not work for any of the channels to read waveform samples. Using the vacant time slots, the CPU 10 is capable of accessing the devices connected to the PCI bus 28. For example, it is possible to write waveform data into the waveform memory 24; it is possible to edit waveform data; or it is possible to enable inputting and outputting of MIDI data via the MIDI interface 17. Further, it is possible to refresh the waveform memory 24.

Next, a further explanation will be given with respect to the process A, process B, load process and interpolation process respectively.

First, an in-depth description will be given with respect to the process A which is executed by the process-A operation circuit 38. Now, the apparatus receives an instruction to start generation of a musical tone using a certain channel. Upon the receipt of the instruction, the process-A operation circuit 38 starts the process A with respect to the channel. As described before in conjunction with FIGS. 7A and 8A, the process A is executed in accordance with the time-division-channel timings. At a first time slot of the channel (specifically, just after a leading-edge timing of a note-on signal instructing the apparatus to start generation of a musical tone), the process-A operation circuit 38 initializes the address storage area (consisting of ADH and ADL) of the address RAM 39 which corresponds to the channel. That is, a certain initial value is set to the address storage area. Herein, the initial value indicates a head address to read out waveform data. The initial value is designated by the CPU 10 by means of the control register 31. Thereafter, the process-A operation circuit 38 sequentially performs additions of a pitch to a current address value which is currently set to the address storage area of the address RAM 39 corresponding to the channel. Herein, the pitch corresponds to an address increment value (i.e., F-number) which is set with respect to the channel. The additions are performed with respect to time slots following the first time slot of the channel. Incidentally, the pitch is designated by the CPU 10 by means of the control register 31.

Results of the additions are stored in the high-order-address storage area ADH and low-order-address storage area ADL of the address RAM 39. Herein, the apparatus pays an attention to certain low-order bits, i.e., a third bit and a fourth bit which are counted from a lowest bit position of an address integer part which is produced by the result of the addition. A decision is made as to whether or not a carry occurs from the low-order third bit position to the low-order fourth bit position or its higher order bit position. If a result of the decision indicates an occurrence of the carry, it is necessary to read waveform samples from the waveform memory 24. So, a channel number of the channel on which the carry occurs is written into the control RAM 41. If no carry occurs from the low-order third bit position to the low-order fourth bit position or its higher order bit position, it is not necessary to read waveform samples from the waveform memory 24. So, no channel number is written into the control RAM 41.

As described above, the address is renewed by the addition. Then, the apparatus determines a necessity to access the waveform memory 24 on the basis of an occurrence of a carry which occurs from the low-order third bit position to the low-order fourth bit position or its higher order bit position in the address integer part of the renewed address. Reasons why the apparatus determines such a necessity on the basis of the occurrence of the carry will be described below.

In the present embodiment, 1 waveform sample is represented by 16-bit data. On the other hand, the PCI bus 28 is capable of transferring 32-bit data. Further, the process-B operation circuit 42 is designed to perform the burst reading operations, as shown in FIG. 8B, such that data of 4 words are consecutively read out by one access. Therefore, only one access to the waveform memory 24 allows reading of 8 waveform samples by means of the load circuit 43. So, only when a carry occurs between the low-order third bit position and low-order fourth bit position, in other words, only when a change occurs on higher order bits of the address excluding 3 bits of low order positions, the apparatus is required to read new waveform samples from the waveform memory 24.

Incidentally, the waveform data stored in the waveform memory 24 is constructed by an attack portion and its following loop portion. An access to the waveform samples is started from a head part of the attack portion; then, after completely reading out the attack portion, reading is performed on the loop portion. Thereafter, the waveform samples of the loop portion are repeatedly read out on demand. To enable such repeat reading, when an address value advances to match with a last position of the loop portion, it is necessary to return it to match with a certain position in proximity to a head position of the loop portion. In other words, it is necessary to perform a process to return the address to the position near the head position of the loop portion. The aforementioned process-A operation circuit 38 is designed to perform such a process as well during creation of the addresses.

As described above, using the time slot of the channel, the pitch (i.e., F-number) is accumulated onto the address value on the address RAM 39. Thus, it is possible to sequentially create addresses with respect to the channel.

The process A incorporates the foregoing creation of the addresses for each channel. In addition, the process A advances the aforementioned write pointer of the control RAM 41 by '1'. So, it executes writing of a channel number representing a channel which requires reading of waveform samples from the waveform memory 24.

Next, an in-depth description will be given with respect to the process B which is executed by the process-B operation circuit 42. As described before, the process-B operation circuit 42 performs the process B at the timings which are provided independently of the time-division-channel timings. That is, the process-B operation circuit 42 outputs a usage request to use the PCI bus 28 toward the bus arbiter. Then, after receiving a usage right, it sends out a head address to perform burst reading operations on the waveform memory 24. As shown in FIGS. 8A and 8B, a time unit of a time-division-channel timing per each channel corresponds to 10 bus clock pulses, wherein it is possible to read out 16 waveform samples. In the process B, access operations are performed on the waveform memory 24 at the timings independently of the time-division-channel timings. Herein, the access operations are sequentially and consecutively performed with respect to the channel which requires reading of waveform samples. A channel number representing the above channel which requires the reading of the waveform samples is determined by the aforementioned process A and is stored in the address RAM 39.

Incidentally, if a time lag is provided to obtain the usage right after the usage request is sent to the bus arbiter, the access operations are delayed in response to the time lag by a certain time which corresponds to 1 bus clock pulse or more.

When the process B is started, a decision is firstly made as to whether or not a value of the read pointer of the control RAM 41 (see FIG. 5) coincides with a value which is set to the write pointer when the first-half process or second-half process is ended. For example, when the process B proceeds to the first-half process 702 (see FIG. 7B), a value of the read pointer is compared with a value which is set to the write pointer when the first-half process 701 of the process A (see FIG. 7A) is ended. If they coincide with each other, it can be said that no waveform samples should be read out in the first-half duration 702 of the process B. In that duration, reading operations are not performed on the waveform memory 24.

If a value of the read pointer does not coincide with a value of the write pointer, it is necessary to access the waveform memory 24 to read out waveform samples. So, a bus usage request is sent to the bus arbiter. In addition, the process-B operation circuit 42 advances the read pointer by '1'. Thus, it reads out a channel number which is stored at a certain location of the control RAM 41 designated by the advanced read pointer. Then, the apparatus accesses the storage portions ADH and ADL of the address RAM 39 with respect to the channel corresponding to the channel number, thus reading out high-order 24 bits of the address integer part. Then, 2 bits representing '00' are added to the high-order 24 bits in low order positions. An address reference value WA is provided to convert a relative address, set to the control register 31, to an absolute address. This address reference value WA is added to data of added bits described above, thus producing a read address WMA. The read address WMA is sent to the waveform memory 24.

Suppose that, as shown in FIG. 8B, the channel 2 and channel 5 are stored in the control RAM 41 as channel numbers representing channels which require reading of waveform samples. Herein, a head address 'WMA' to perform reading with respect to the channel 2 is outputted at a first bus clock timing (i.e., the first of the aforementioned fine segment timings). Then, a head address 'WMA' to perform reading with respect to the channel 5 is outputted at a fifth bus clock timing. As described above, the read addresses for the channels which require reading of waveform samples are sequentially outputted while advancing the read pointer of the control RAM 41. Thereafter, when a value of the read pointer coincides with a value of the write pointer, the outputting of the read addresses is completed.

Next, an in-depth description will be given with respect to the load process which is executed by the load circuit 43. As shown in FIG. 3, the process-B operation circuit 42 supplies the load circuit 43 with a channel number 'chN' and a read clock signal 'rclk'. The aforementioned burst reading operations are performed, using the read addresses WMA given from the process-B operation circuit 42, on the waveform memory 24 to read out waveform samples. Based on the channel number chN and read clock signal rclk, the load circuit 43 loads the waveform samples therein and writes them into the dual-port memory 44. As a result of the loading described above, the dual-port memory 44 renews 8 waveform samples of the storage areas thereof. In other words, all the 8 waveform samples are replaced by new waveform samples.

Next, an in-depth description will be given with respect to the interpolation process which is executed by the interpolation circuit 46. As described before in conjunction with FIG. 8D, the interpolation circuit 46 is designed to perform the interpolation process in accordance with the time-division-channel timing with respect to each channel. The details of the interpolation process regarding one channel will be described below.

As shown in FIG. 6, the buffer 45 stores 4 waveform samples S1 to S4, whilst the dual-port memory 44 stores 8 waveform samples S5 to S12. Before new waveform samples are written into the dual-port memory 44, old waveform samples which are stored in the storage areas S9 to S12 of the dual-port memory 44 are transferred to the storage areas S1 to S4 of the buffer 45. In other words, the waveform samples currently stored in the storage areas S1 to S4 correspond to the waveform samples previously stored in the storage areas S9 to S12. So, the waveform samples S1 to S4 closely relate to the waveform samples S9 to S12. Namely, the waveform samples S1 to S4 of the buffer 45 continue to the waveform samples S9 to S12 of the dual-port memory 45.

As shown in FIG. 3, the process-B operation circuit 42 supplies the interpolation circuit 46 with the address decimal part FRAC as well as the low-order 3 bits 'INT3' of the address integer part. Based on the low-order 3 bits INT3 of the address integer part, the interpolation circuit 46 accesses the dual-port memory 44 and the buffer 45 to read out 4 waveform samples. In addition, each of the waveform samples is multiplied by an interpolation coefficient which is determined based on the address decimal part FRAC. Then, the multiplied waveform samples are accumulated. Thus, the interpolation circuit 46 performs 4-point interpolation calculations. So, the interpolation circuit 46 produces interpolated musical-tone-waveform samples.

Referring to FIG. 6, a description will be given with respect to the waveform samples which are used by the interpolation calculations with respect to each timing. Numbers '0' to '7' written on the right side of the dual-port memory 44 and the buffer 45 shown in FIG. 6 are decimal numbers each of which represents the low-order 3 bits INT3 of the address integer part. In case of INT3=0, the interpolation circuit 46 picks up 3 waveform samples S2, S3 and S4 of the buffer 45 as well as 1 waveform sample S5 of the dual-port memory 44. Thus, the interpolation circuit 46 uses total 4 waveform samples S2 to S5 for execution of the interpolation calculations. In case of INT3=1, the interpolation circuit 46 picks up the waveform samples S3, S4, S5 and S6. Similarly, in case of INT3=7, the interpolation circuit 46 picks up the waveform samples S9 to S12. Thus, the interpolation circuit 46 performs the interpolation calculations on 4 waveform samples which differ with respect to each value of INT3.

As described above, the interpolation circuit 46 performs the interpolation calculations using the waveform samples which are determined in response to the value of INT3. If the value of INT3 is 3 or more, the waveform samples S1 to S4 of the buffer 45 are not used. For this reason, if the value of INT3 becomes equal to '3', the waveform samples S9 to S12 of the dual-port memory 44 are transferred to the buffer 45. Such a data transfer enables the waveform samples S9 to S12 to refuge at a renewal mode which is established when a carry occurs on the address from the low-order third bit position to its higher bit position so that the contents of the dual-port memory 44 are renewed by new 8 waveform samples which are read from the waveform memory 24 in accordance with the aforementioned burst reading operations. So, the waveform samples S9 to S12 can be used for the interpolation calculations which are performed when the value of INT3 nextly matches with a range of values between '0' and '2'.

In some case, when a new address is created by adding the F-number to the current address value by the process A, a carry occurs on the address from the low-order third bit position to a certain higher-order bit position which is higher than the low-order fourth bit position. In such a case, an access process is executed on the waveform memory 24 in the process B which is started just after the above process A.

As described heretofore, the present embodiment is designed such that the waveform memory is connected to the high-speed bus having a capability to transfer multiple waveform samples. So, it is possible to read out multiple waveform samples simultaneously by one access to the waveform memory. In addition, the present embodiment is designed such that the read waveform samples are temporarily stored in the waveform buffer. This eliminates a necessity to read out the waveform samples, stored in the waveform buffer, from the waveform memory again. Further, the present embodiment is capable of performing the burst reading operations to read out consecutive 8 waveform samples by one access, which are stored in the waveform buffer. Thus, it is possible to remarkably reduce a number of times to access the waveform memory.

By the way, the present embodiment is designed such that the dual-port memory 44 and the buffer 45 both provide a number of storage areas which are capable of storing a number of waveform samples with-respect to all of 64 channels. However, this invention does not necessarily require such a large storage capacity. So, the present embodiment can be modified to provide a limited number of storage areas for the waveform buffer which is capable of storing waveform samples regarding a part of the channels only. For example, the waveform buffer is re-designed to provide a limited storage capacity which is capable of storing waveform samples with respect to 32 channels. In such a case, waveform samples regarding remaining 32 channels are read out in accordance with the time-division-channel timings. Even in such a re-designed embodiment, as compared with the conventional example that 4 waveform samples used for interpolation calculations are read out by each time-division-channel timing, it is possible to remarkably reduce a number of times to access the waveform memory.

Figure 9:
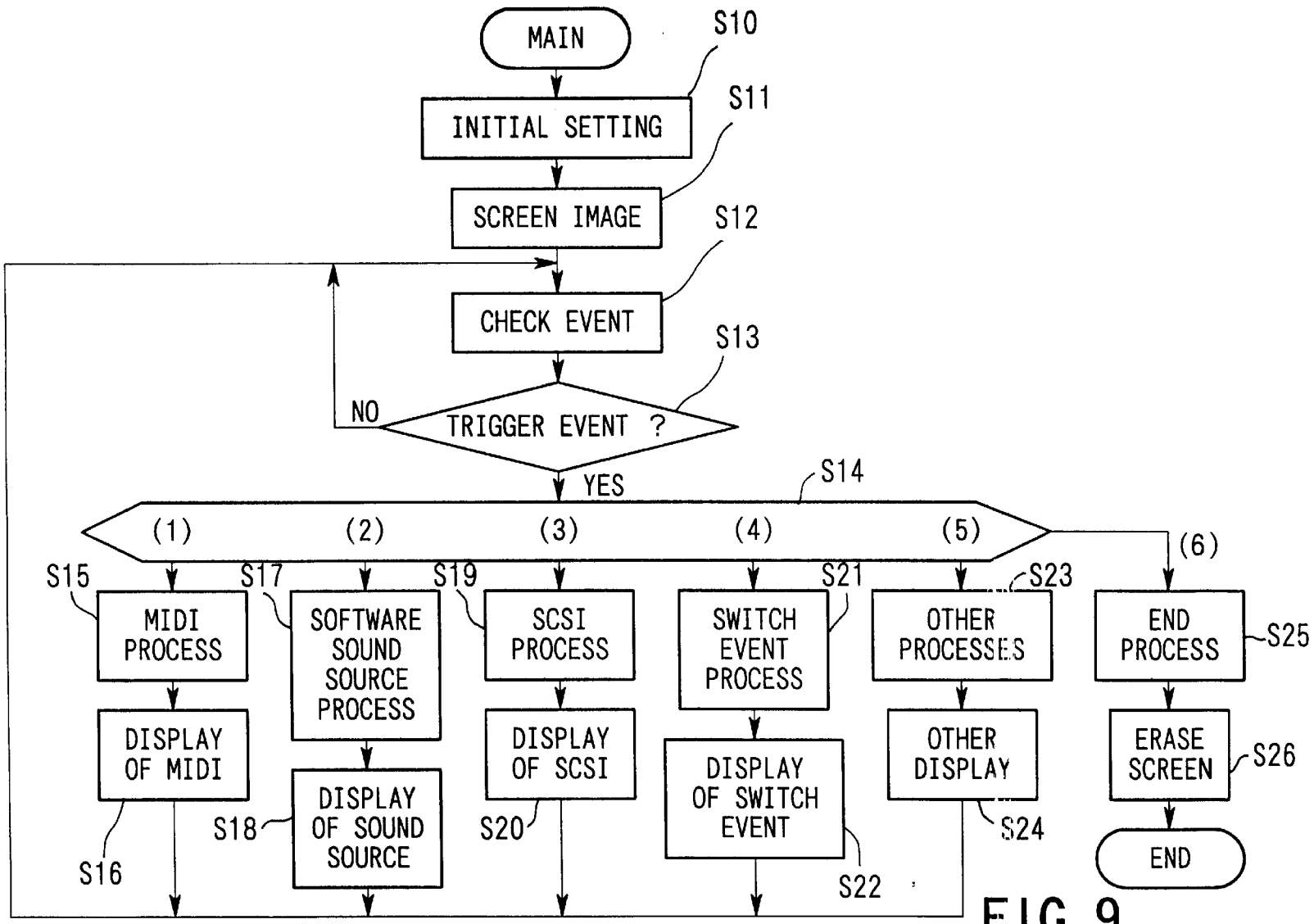
FIG. 9 is a flowchart showing a basic operation program.

Next, a description will be given with respect to an outline of a basic operation program of the musical tone generation apparatus with reference to a flowchart of FIG. 9. Herein, the basic operation program is stored in the aforementioned flash memory 11. When the basic operation program is started, the apparatus executes an initial setting process in step S10 to secure register areas and the like. In step S11, an initial screen image is displayed on a screen of the display unit. Then, the apparatus is placed in a standby mode (see steps S12 and S13) which is maintained until a trigger event occurs. When the trigger event occurs, the apparatus discriminates the content of the trigger event in step S14 so as to proceed to a certain process. In the present embodiment, there are provided 6 kinds of trigger events, as follows:

(1) A first trigger event that MIDI data are written into an input buffer.

(2) A second trigger event that a trigger is produced to perform waveform creation calculations.

(3) A third trigger event that an interrupt occurs from the SCSI interface.

(4) A fourth trigger event that a switch event occurs from panels or windows screens.

(5) A fifth trigger event that the apparatus executes a waveform editing process, an automatic performance process and the like.

(6) A sixth trigger event that an end request occurs.

In response to the above trigger events, the apparatus executes a MIDI process (S15), a software sound source process (S17), a SCSI process (S19), a switch event process (S21), other processes (S23) and an end process (S25) respectively.

The MIDI process of step S15 is started by an interrupt to receive a MIDI signal from the MIDI interface 17. In the MIDI process, the CPU 10 firstly obtains a bus usage right to use the PCI bus 28. So, the apparatus receives MIDI data via the MIDI interface 17 and loads it to the RAM 12. The CPU 10 performs a process corresponding to the loaded MIDI data. For example, if the apparatus receives a note-on signal, the CPU 10 performs a variety of processes such as an assignment process of a tone-generation channel and a process to prepare tone color data. Then, the CPU 10 obtains a bus usage right to use the PCI bus 28 again. So, the CPU 10 performs a process to set a control register for the assigned channel of the sound source section 25 as well as a process to send out a tone-generation start instruction (i.e., note-on instruction) to the assigned channel. Incidentally, a control register for the software sound source is provided inside of the RAM 12 in the case where tone generation is performed using the software sound source, the content of which will be described later. In that case, it is not necessary to obtain the usage right of the PCI bus 28 twice.

The switch event process of step S21 is started by an occurrence of a switch event on a switch of the switch unit 22. In the switch event process, the CPU 10 firstly secures a bus usage right of the PCI bus 28. Then, the CPU 10 accesses the I/O control circuit 23 to make a confirmation as to which of the switches of the switch unit 22 the switch event occurs, in other words, which of the switches is manipulated. So, the CPU 10 executes a process corresponding to the manipulated switch. For example, the CPU 10 executes a waveform selecting process, a waveform editing process, a hard disk control process, a sampling process, start/stop control processes of an automatic performance or start/end processes of the software sound source.

In the software sound source process of step S17, the CPU 10 performs creation of musical-tone-waveform samples by waveform creation calculations without using the sound source section 25. That is, the CPU 10 performs the waveform creation calculations based on data of the control register(s) of the RAM 12. So, the software sound source process is capable of synthesizing waveform samples using the tone color which is not stored in the waveform memory, or it is capable of simulating generation of musical tones by the sound source which operates based on a different theory. When starting the software sound source in the present embodiment, the waveform memory is used as a reproduction buffer. In that case, multiple waveform samples which are previously created by the software sound source process are stored in a buffer area of the waveform memory. For this reason, a setting is made on the apparatus in such a manner that the sound source section 25 uses any one of the channels to read out the waveform samples from the buffer area and to reproduce them. If an amount of waveform samples of the buffer area which have not been reproduced is reduced less than a certain amount of waveform samples, a trigger occurs on the aforementioned waveform creation calculations. So, the software sound source process is started in response to the trigger so that new waveform samples are created on the RAM 12 to refill up the buffer area. Then, the CPU 10 obtains a bus usage right of the PCI bus 28; and consequently, the CPU 10 transfers the newly created waveform samples to the buffer area of the waveform memory 24. According to the method described above, creation of the waveform samples by the software sound source is performed using the CPU local bus 13; then, the PCI bus 28 is used only when the created waveform samples are transferred to the buffer area of the waveform memory 24. Thus, processing can be performed at a high speed. In addition, there is no waste in usage of the PCI bus 28.

The SCSI process of step S19 is started by an interrupt signal given from the SCSI interface 19 so as to perform input/output operations with respect to the external storage device 20. Herein, the SCSI interface 19 is mainly used to perform a data transfer between the waveform memory 24 (or the RAM 12) and an external storage device such as a hard-disk unit which is connected to a SCSI bus. For example, if the switch unit 22 is manipulated to provide an instruction to transfer waveform samples from the hard-disk unit to the waveform memory 24, the CPU 10 obtains a bus usage right of the PCI bus 28 by the aforementioned switch event process. So, the CPU 10 controls operations of the hard-disk unit by means of the SCSI interface 19. In addition, the CPU 10 secures a write area within the waveform memory 24. Further, the CPU 10 makes a setting of a data transfer circuit which is provided inside of the SCSI interface 19. Then, the SCSI interface 19 obtains a bus usage right of the PCI bus 28 every time it receives a predetermined amount of waveform samples from the hard-disk unit. In accordance with the aforementioned setting, the received waveform samples are sequentially written into the write area of the waveform memory 24. Incidentally, the SCSI interface 19 makes an interrupt on the CPU 10 when a new control is required, for example, when the writing of the write area is ended. In response to the interrupt, the CPU 10 performs the SCSI process of step S19 to secure a new write area.

When the switch unit 22 is manipulated to provide an instruction to start the sampling process, the CPU 10 performs the switch event process to achieve a series of operations as follows:

The CPU 10 obtains a bus usage right of the PCI bus 28. A buffer area is set within the waveform memory 24. In addition, a certain sampling frequency is set to the A/D converter 15. Further, a setting is made on an internal data write circuit.

Following the above operations, the A/D converter 15 is activated to obtain a bus usage right of the PCI bus 28 by each sampling period. So, digitalized samples representing an input waveform are written into the buffer area.

When the switch unit 22 is manipulated to designate the waveform editing process, the CPU 10 performs the switch event process to achieve a series of operations as follows:

First, the CPU 10 secures a bus usage right of the PCI bus 28. Then, waveform samples which should be edited are transferred from the waveform memory 24 to the RAM 12.

The designated waveform editing process is executed on the RAM 12, thus providing edited waveform samples. Then, the edited waveform samples are transferred to the waveform memory 24. Herein, to prevent a multitask response of the apparatus from being damaged, the waveform editing process is divided into multiple segment processes, each of which is executed as the other processes in step S23. Incidentally, the waveform editing process can be performed in the sound source section with respect to the waveform which is currently read out. Or, results of the waveform editing process can be sequentially written into the waveform memory 24 as waveforms which the sound source section 25 should read out next.

When the switch unit 22 is manipulated to provide an instruction to start an automatic performance, the CPU 10 performs the switch event process to achieve a series of operations as follows:

The CPU 10 obtains a bus usage right of the PCI bus 28. Automatic performance data of the external storage device are loaded to the RAM 12. So, the CPU 10 starts the automatic performance based on the automatic performance data loaded to the RAM 12.

Thereafter, the other processes of step S23 are started in accordance with certain event timings, so reproduction is made on a MIDI event. In response to the reproduced MIDI event, the aforementioned MIDI process of step S15 is started.

When the switch unit 22 is manipulated to provide an instruction to end operations of the electronic musical instrument, the CPU 10 performs the end process of step S25 to refuge setting data and clear registers. After completion of the end process, the CPU 10 proceeds to step S26 to erase the screen image. Then, operations of the apparatus is ended.

According to the present embodiment described heretofore, some elements of the apparatus such as the CPU 10, A/D converter 15, SCSI interface 19 and sound source section 25 are each designed to obtain a bus usage right of the PCI bus 28 to perform operations thereof. So, if it is possible to reduce an occupancy time to use the PCI bus 28 as well as a number of times to use the PCI bus 28 by the sound source section 25, it is possible to improve an access speed of the above elements other than the sound source section 25.

In the present embodiment, both of the CPU 10 and the sound source section 25 are connected to the PCI bus 28, so they access to the waveform memory 24 by means of the PCI bus 28. So, the CPU is capable of accessing the waveform memory at a high speed. None of the conventional sound sources of the waveform memory type which perform operations of multiple channels is capable of realizing such a high-speed access of the CPU to the waveform memory. Thanks to the configuration of the present embodiment, the waveform memory can be supplied with the waveform from the software sound source; further, it is possible to perform real-time editing on the waveform samples which the sound source section 25 is currently reading out.

By the way, the present embodiment is configured by hardware elements as shown in FIG. 1. However, those elements can be realized by the software which is executed by the CPU or a DSP (i.e., digital signal processor).

In the present embodiment, the waveform memory provides an address with respect to each waveform sample. Of course, this can be modified. So, it is possible to handle a certain number of waveform samples as a single storage unit.

In the present embodiment, the storage capacity of the waveform buffer is determined to store 12 waveform samples with respect to each chanel. Such a number of waveform samples can be changed in response to the method to create musical tones. However, the present embodiment is basically designed such that a unit number to read samples at once (i.e., sample read number) corresponds to 8 waveform samples. So, it is efficient for the waveform buffer to provide the storage capacity which is capable of storing 8 waveform samples or more. In addition, if n-point interpolation calculations (where 'n' is an integer) is performed like the present embodiment, it is preferable for the waveform buffer to provide the storage capacity which is capable of storing at least 'm' waveform samples, wherein 'm' is a sum of (sample read number) and (n-1).

Furthermore, this invention is not limited to the present embodiment with regard to the sample read number. So, the sample read number does not necessarily correspond to 8 waveform samples. As the sample read number is increased, the storage capacity of the waveform buffer should be correspondingly increased. However, it is possible to reduce a number of times to access the waveform memory in response to an increase of the storage capacity of the waveform buffer.

By the way, a musical tone waveform consists of a number of samples, each representing an amplitude, which are distributed with regard to phases ranging from 0 and 2 $\pi$, for example. A musical tone phase represents an address to read out stored waveform data, wherein bit data thereof are classified into 3 groups which are called a high-order portion, a middle-order portion and a low-order portion. Those portions correspond to parts of the address stored in the address RAM 39. Namely, the high-order portion corresponds to high-order 24 bits of the address integer part; the middle-order portion corresponds to low-order 3 bits of the address integer part; and the low-order portion corresponds to the address decimal part. So, the present embodiment is capable of creating the above portions respectively by using the above parts of the address. However, this invention is not limited to the present embodiment with regard to the creation of the musical tone phase. If the sample read number corresponds to 12 waveform samples, for example, the quotient which is obtained by dividing the address integer part by '12' is used for the high-order portion, whilst the remainder is used for the middle-order portion.

Lastly, the present embodiment is designed to use the PCI bus. This invention is designed to use the high-speed bus which does not necessarily correspond to the PCI bus. So, it is possible to use other high-speed buses such as 64-bit extended PCI bus, VL bus (i.e., VESA Local bus where 'VESA' is an abbreviation for 'Video Electronics Standard Association), EISA bus (where EISA' is an abbreviation for 'Extended Industrial Standard Architecture').

Applicability of this invention can be extended in a variety of ways. As the storage media, it is possible to employ CD-ROMs, magneto-optics disks and floppy disks other than the hard disks. So, it is possible to provide the user with a CD-ROM storing operation programs of this invention and data representing a variety of constants. Or, it is possible to supply the external storage device 20 and/or the flash memory 11 with version-up programs and data by means of the CD-ROM. Further, the musical tone generation apparatus can be linked with a server computer via a communication network such as a local area network (LAN), a computer network such as 'internet' and telephone lines. So, programs of this invention and data can be down-loaded to the musical tone generation apparatus from the server computer via the communication network.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical tone generation apparatus which creates a musical-tone-waveform sample based on waveform samples each sampling period, comprising:

a common bus which has a capability of transferring a unit number of waveform samples;

a waveform memory, connected to the common bus, for storing the unit number of waveform samples with respect to each address thereof;

read means, connected to the common bus, for accessing the waveform memory by a read address whose value advances at a speed corresponding to a pitch of a musical tone so as to read out the unit number of the waveform samples by one access;

a buffer memory for storing the unit number of the waveform samples which have been read out by the read means by one access to the waveform memory; and creation means for creating a musical-tone-waveform sample by performing an interpolation calculation selectively using the necessary samples within the multiple samples stored in the buffer on the basis of the address, wherein the read means includes a determination means for determining whether the buffer memory is storing the necessary waveform samples on the basis of the read address which are necessary for the creation means to create the musical-tone-waveform-sample, wherein the read means accesses the waveform memory only when the determination means determines that the buffer memory is not storing the necessary waveform samples.

2. A musical tone generation apparatus according to claim 1 wherein the common bus is configured by a high-speed bus.

3. A musical tone generation apparatus which creates a musical-tone-waveform sample based on waveform samples by each sampling period, comprising:

a common bus utilized by a device which obtains a usage right for the common bus;

a waveform memory, connected to the common bus, for storing a unit number of waveform samples;

read means, connected to the common bus, for accessing the waveform memory to read out the unit number of the waveform samples by one access;

a buffer memory for storing the waveform samples which are sequentially read out by the read means;

creation means for creating a musical-tone-waveform sample by performing an interpolation calculation selectively using the necessary samples within the multiple samples stored in the buffer on the basis of an address; and processing means, connected to the common bus, for performing reading operations and/or writing operations on the waveform memory and for controlling the creation means and the read means, wherein the read means includes a determination means for determining whether the buffer memory is storing the necessary waveform samples on the basis of the read address which are necessary for the creation means to create the musical-tone-waveform-sample, wherein the read means obtains the usage right for the common bus and accesses the waveform memory only when the determination means determines that the buffer memory is not storing the necessary waveform samples.

4. A musical tone generation apparatus according to claim 3 wherein the waveform memory stores a plurality of waveform samples with respect to each address thereof, so the plurality of waveform samples are read out by one access to the waveform memory.

5. A musical tone generation apparatus according to claim 3 wherein the read means performs burst reading operations on the waveform memory to sequentially read out the waveform samples.

6. A musical tone generation apparatus which creates musical-tone-waveform samples based on waveform samples with respect to a plurality of channels by each sampling period, comprising:

common bus utilized by a device which obtains a usage right for the common bus;

waveform memory, connected to the common bus, for storing the waveform samples;

read means, connected to the common bus, for accessing the waveform memory to read out the waveform samples of each of said plurality of channels;

a buffer memory for storing the waveform samples of said plurality of channels which are read out by the read means;

creation means for creating musical-tone-waveform samples on the basis of the waveform samples which are stored in the buffer memory; and processing means, connected to the common bus, for performing reading operations and/or writing operations on the waveform memory and for controlling the creation means, wherein the read means includes a determination means for determining whether the buffer memory is storing the necessary waveform samples of each of said plurality of channels on the basis of a read address of each of said plurality of channels, which are necessary for the creation means to create the musical-tone-waveform-sample of each of said plurality of channels, wherein only when the determination means determines that the buffer memory is not storing the necessary samples, the read means obtains the usage right for the common bus and accesses the waveform memory to read out the necessary waveform samples with respect to the channels of which the buffer is not storing the necessary waveform samples.

7. A musical tone generation apparatus according to claim 6 wherein the common bus is configured by a high-speed bus.

8. A musical tone generation apparatus which creates a musical-tone-waveform sample based on waveform samples by each sampling period, comprising:

common bus;

waveform memory, connected to the common bus, for storing a unit number of waveform samples;

read means, connected to the common bus, for accessing the waveform memory to read out the unit number of the waveform samples;

a buffer memory for storing the waveform samples which are sequentially read out by the read means;

phase generation means for generating a musical tone phase consisting of a high-order portion, a middle-order portion and a low-order portion;

creation means for performing interpolation calculations based on the low-order portion of the musical tone phase to create a musical-tone-waveform sample, wherein the creation means designates waveform samples, selected from among the waveform samples stored in the buffer memory, in accordance with the middle-order portion of the musical tone phase, so the interpolation calculations are performed using the designated waveform samples; and processing means, connected to the common bus, for performing reading operations and/or writing operations on the waveform memory and for controlling the creation means and the phase generation means, wherein the read means accesses the waveform memory only when a change occurs on the high-order portion of the musical tone phase.

9. A musical tone generation apparatus according to claim 6 wherein the musical tone phase corresponds to an address used to access the waveform memory.

10. A musical tone generation apparatus comprising:

a high-speed bus;

a waveform memory, connected to the high-speed bus, for storing waveform samples;

a waveform buffer for temporarily storing the waveform samples read from the waveform memory;

sound source means, connected to the high-speed bus, which operates in accordance with time-division-channel timings which are provided by dividing a sampling period by a number of channels, the sound source means creating a musical-tone-waveform sample based on the waveform samples in accordance with each time-division-channel timing with respect to each channel; and read address generating means for generating a read addresses for multiple channels whose values are changed in response to a pitch of a musical tone; and access means which determines whether the waveform buffer stores the necessary samples on the basis of one of the read addresses and which is activated when the waveform buffer does not store waveform samples which are necessary for the sound source means to create the musical-tone-waveform sample, so the access means accessing the waveform memory in accordance with one of the read addresses to read out the waveform samples, which are transferred to the waveform buffer via the high-speed bus.

11. A musical tone generation apparatus according to claim 10 wherein burst reading operations are performed, regardless of the time-division-channel timing on the waveform memory to read out the waveform samples which are necessary for the sound source means to create the musical-tone-waveform sample.

12. A musical tone generation apparatus according to claim 10 wherein the sound source means performs interpolation calculations on the waveform samples to create the musical-tone-waveform sample in accordance with the time-division-channel timing with respect to each channel.

13. A musical tone generation apparatus according to claim 10 wherein the high-speed bus corresponds to a PCI bus.

14. A computer-readable media storing programs and data that cause a computer-incorporated system to execute a musical tone generation method comprising the steps of:

storing waveform samples in a waveform memory;

selectively transferring the waveform samples of the waveform memory to a waveform buffer via a high-speed bus;

creating musical-tone-waveform samples based on the waveform samples temporarily stored in the waveform buffer with respect to a plurality of channels by each sampling period in time division system;

generating read addresses for multiple channels whose values are changed in response to a pitch of a musical tone;

determining whether the waveform buffer stores the necessary samples on the basis of one of the read addresses; and accessing, when the waveform buffer does not store the waveform samples which are necessary to create the musical-tone-waveform samples, the waveform memory in accordance with one of the read addresses to read out the waveform samples, which are transferred to the waveform buffer via the high-speed bus.

15. A computer-readable media according to claim 14 further comprising the step of:

performing interpolation calculations on the waveform samples to create the musical-tone-waveform sample.

16. A musical tone generation method comprising the steps of:

storing waveform samples in a waveform memory;

selectively transferring the waveform samples of the waveform memory to a waveform buffer via a high-speed bus;

creating musical-tone-waveform samples based on the waveform samples temporarily stored in the waveform buffer with respect to a plurality of channels by each sampling period in time division system;

generating read addresses for multiple channels whose values are changed in response to a pitch of a musical tone;

determining whether the waveform buffer stores the necessary samples on the basis of one of the read addresses; and accessing, when the waveform buffer does not store the waveform samples which are necessary to create the musical-tone-waveform samples, the waveform memory in accordance with one of the read addresses to read out the waveform samples, which are transferred to the waveform buffer via the high-speed bus.

* * * * *